United States Patent [19]

Urabe

[11] 4,410,374

[45] Oct. 18, 1983

[54] STEEL HAVING EXCELLENT VIBRATION ATTENUATION PERFORMANCE AND METHOD OF MANUFACTURING THE SAME

[75] Inventor: Namio Urabe, Kamakura, Japan

[73] Assignee: Nippon Kokan Kabushiki Kaisha, Tokyo, Japan

[21] Appl. No.: 212,501

[22] Filed: Dec. 3, 1980

Related U.S. Application Data

[63] Continuation of Ser. No. 47,498, Jun. 11, 1979, abandoned.

[30] Foreign Application Priority Data

Jun. 22, 1978 [JP] Japan ..... 53-74879

[51] Int. Cl.[3] ..... C21D 1/18

[52] U.S. Cl. ..... 148/143; 148/16.5; 148/39

[58] Field of Search ..... 148/143, 36, 37, 39, 148/12 R, 16.5; 75/125, 123 R

[56] References Cited

U.S. PATENT DOCUMENTS

| | | | |
|---|---|---|---|
| 3,619,302 | 11/1971 | Aoki et al. | 148/143 |
| 3,655,465 | 4/1972 | Snape et al. | 148/143 |
| 4,152,177 | 5/1979 | Mantel et al. | 148/16.5 |
| 4,204,888 | 5/1980 | Masumoto et al. | 148/12 R |

FOREIGN PATENT DOCUMENTS

| | | |
|---|---|---|
| 1137952 | 12/1968 | United Kingdom . |
| 1292637 | 10/1972 | United Kingdom . |
| 1484718 | 9/1977 | United Kingdom . |

*Primary Examiner*—L. Dewayne Rutledge
*Assistant Examiner*—Robert McDowell
*Attorney, Agent, or Firm*—Frishauf, Holtz, Goodman & Woodward

[57] ABSTRACT

Steel having a structure of ferrite and tempered martensite and exhibiting excellent vibration attenuation characteristic is manufactured by the steps of forming a solid solution of steel consisting essentially of 0.02~0.016% by weight of carbon; less than 0.6% by weight of silicon; 0.5~1.5% by weight of manganese; either one or more of 5~15% by weight of chromium and 2~9% by weight of tungsten; either one or both of 0.03~2% by weight of aluminum and 0.1~5% by weight of cobalt; less than 1.5% by weight of copper, if necessary, and the balance of iron; heating and keeping for a desired time period the alloyed steel in a temperature range in which austenite and ferrite coexist; cooling the steel so as to transform austenite to martensite; and tempering the steel at a temprature of from 400° C. to a temperature below a transformation point thus forming a structure of ferrite and martensite. Steel incorporated with copper is suitable for precipitation hardening. Advantageously, the amount of the tempered martensite should be less than 60% by volume.

13 Claims, 8 Drawing Figures

STEEL HAVING EXCELLENT VIBRATION ATTENUATION PERFORMANCE AND METHOD OF MANUFACTURING THE SAME

This is a continuation, of application Ser. No. 47,498 filed June 11, 1979 now abandoned.

BACKGROUND OF THE INVENTION

This invention relates to steel having an excellent vibration attenuation performance in addition to such basic characteristics of steel as the strength, toughness, corrosion resistant characteristic, and weldability and a method of manufacturing the same.

In recent years, vibrations and noises are restricted by laws or regulations as a source of public hazard. Moreover, vibrations generated by household electric appliances, business machines, traffic and transporting machines and various mechanical facilities cause fatigue damage of such machines and component parts thereof so that prevention of vibration is important to elongate their lives. Various attempts have been made to decrease the detrimental effects of the vibration. Among various solutions may be mentioned increase in the mass and rigidity of a member acting as a source of vibration, and an appropriate design effective to avoide dangerous resonance. Such solutions are inadvantageous in machines and apparatus whose accuracy and balance have already been investigated in a range permissible from the standpoint of economy since excess equipments must be added thereto. Elastic materials have been used for damping vibration. Such elastic materials as rubber and plastics have mechanical characteristics different from those of metallic materials. Use of such elastic materials increases the volume of the machine and cost of manufacturing. If it were possible to construct members acting as the source of vibration or vibration transmitting members with metallic materials having a high attenuation performance it would be possible to efficiently decrease undesirable vibrations without affecting basic design. Consequently, research has been made to find out metallic materials having high attenuation performance. As a consequence, Mg alloys in which a small quantity of Zn is incorporated into Mg, Mn-Cu alloys consisting essentially of Mn and Cu, and NiTi alloys containing Ni and Ti at a ratio of 50:50 have been developed. However, the Mg alloys have low mechanical strength so that they can not be used to manufacture ordinary mechanical component parts. Although Mn-Cu alloys and NiTi alloys have a relatively high mechanical strength and excellent vibration attenuation performance at or near room temperature, since their vibration attenuation performance depends upon interaction between the lattice vibration and the transformed twin crystal their operating temperature is limited to below about 80° C. so that it is impossible to use these alloys to construct internal combustion engines, electric motors and component parts thereof which generate vibrations. Composite vibration absorbing member comprising two steel plates and an elastic member interposed therebetween has been widely used. However, since the elastic member has poor heat resistant property so that its operating temperature is limited to approximately 80° C. On the other hand, steels relating to ferritic stainless steel containing about 10% of chromium and ferritic stainless steel containing about 10% of chromium and a large quantity of aluminum attribute their vibration attenuation performance to the interaction between the lattice vibration and the movable magnetic domain walls of steel they can maintain high attenuation performance up to a temperature near 300° C. but as they are in the form of a single phase of ferrite and do not undergo any phase transformation below their melting points it is impossible to be hardened by heat treatments. For this reason, they can not be used to construct mechanical parts requiring high mechanical strength, for example, power transmission gears, lath parts, etc.

SUMMARY OF THE INVENTION

Accordingly it is an object of this invention to provide steel having excellent vibration attenuation performance in a range of from a relatively low temperature to a considerably high temperature in addition to favourable strength, toughness, corrosion proof property and weldability.

Another object of this invention is to provide steel having above described excellent vibration attenuation performance and can readily control its mechanical strength and toughness by heat treatment.

Still another object of this invention is to provide steel which when used to construct machines and apparatus inherently generating vibration and noise can eliminate use of rubber or other resilient materials which have been used to prevent vibration and noise.

According to one aspect of this invention there is provided steel having a structure of ferrite and tempered martensite and exhibiting excellent vibration attenuation performance, characterized in that the steel consists of 0.02~0.16% by weight of carbon; less than 0.6% by weight of silicon; 0.5~1.5% by weight of manganese; either one or more of 5~15% by weight of chromium, and 2~9% by weight of tungsten; either one or both of 0.03~2% by weight of aluminum and 0.1~0.5% by weight of cobalt; less than 1.5% by weight of copper, if necessary; and the balance of steel.

According to another aspect of this invention there is provided a method of manufacturing steel exhibiting an excellent vibration attenuation performance, characterized by the steps of forming an alloyed steel consisting essentially of 0.02~0.16% by weight of carbon; less than 0.6% by weight of silicon; 0.5~1.5% by weight of manganese; either one or more of 5~15% by weight of chromium and 2~9% by weight of tungsten; either one or both of 0.03~2% by weight of aluminum and 0.1~5% by weight of cobalt; less than 1.5% of copper, if necessary; and the balance of iron; heating and keeping for the desired time period the alloyed steel in a temperature range in which austenite and ferrite coexist; cooling said steel so as to transform austenite to martensite; and tempering said steel at a temperature of from 400° C. to a temperature lower than a transformation point, thus forming a structure of ferrite and martensite.

BRIEF DESCRIPTION OF THE DRAWINGS

The invention can be more fully understood from the following detailed description taken in conjunction with the accompanying drawings in which.

DESCRIPTION OF THE PREFERRED EMBODIMENTS

Figure 1:
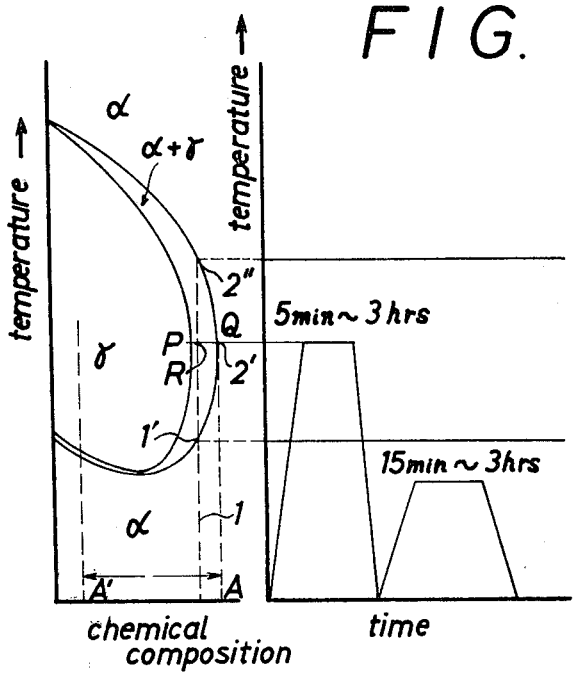
FIG. 1 is a diagram showing the result of one example of heat treatment.

As above described, the structure of the steel of this invention consists of ferrite and tempered martensite so that it is possible to improve the strength of the steel by increasing the amount of the tempered martensite having a high strength. For this reason, it is possible to vary the strength of steel of the same composition over a relatively wide range by adjusting the proportion of the tempered martensite. Such unique characteristic can never be realized by ordinary high vibration attenuation steel consisting of a single phase of ferrite. The vibration attenuation performance of steel decreases as the amount of martensite is increased but it is nonsense to improve the vibration attenuation characteristic beyond that required. Thus, the composition and the amount of the tempered martensite of the steel are determined by taking into consideration the relationship between the strength and the attenuation performance. However, if the amount of the tempered martensite were excessive, it would be difficult to maintain the attenuation characteristic in a preferred range so that it is generally advantageous to select the amount of the tempered martensite to be less than 60% by volume.

The reason for limiting the composition of the steel is as follows:

In the following description all parts are by weight. Carbon is effective as a solid solution hardening agent when its content is higher than 0.02% but when its content exceeds 0.16% the weldability of the steel degrades greatly so that 0.16% is the upper limit. As above described, since the excellent vibration attenuation performance of the steel of this invention is caused by the interaction between the lattice vibration and the movable magnetic domain walls of the steel, in order to give this property to the steel it is essential that the steel should contain chromium of above 5% and/or tungsten of more than 2%. When chromium content is higher than 15% and/or when tungsten content is higher than 9%, these elements cooperate with other additive elements to render the structure of the steel to be a ferrite single phase thus rendering it impossible to increase the mechanical strength by heat treatment. For this reason, 15% and 9% constitute the upper limits of chromium and tungsten respectively. Aluminum and cobalt are elements necessary to improve the vibration attenuation performance of the steel and to prevent decrease in the magnetic transformation point thereof caused by the effects of chromium and tungsten. Although aluminum of above 0.03% and cobalt of above 5% are effective, when the content of aluminum exceeds 2%, and when the content of cobalt exceeds 5%, the deformation performance of the steel is degraded so that these contents are the upper limits. The coexistence of aluminum and cobalt in such ranges increases the temperature at which the high vibration attenuation performance can be maintained to 400° C. or more. Although silicon is effective to increase the tensile strength of the steel due to its ability of a solid solution hardening, excessive amount of silicon impairs weldability so that its upper limit should be 0.6%. Manganese is effective to increase the mechanical strength and toughness of the steel so that it is incorporated in an amount of at least 0.5%. However, when the content of manganese exceeds 1.5%, the steel becomes brittle so that 1.5% is the upper limit.

Copper is added to act as a precipitation hardening agent if necessary, and more than 0.5% of copper is ordinary effective but incorporation of copper in excess of 1.5% enbrittles the steel so that this percentage constitutes the upper limit.

As shown by the phase diagrams shown in FIGS. 1 and 2, in the steel of this invention, an austenite loop is formed by the presence of chromium and or tungsten and its composition is in a range between A and A' wherein A represents a point below which phase transformation occurs as the temperature varies and A' represents a limit below which the desired vibration attenuation performance can not be exhibited.

Figure 8:
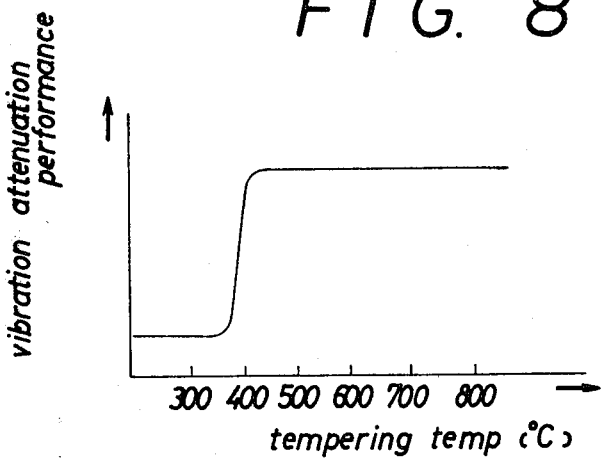
FIG. 8 shows the relation between the tempering temperature and the vibration attenuation performance.

Heat treatment performed by the method of this invention will now be described. Firstly, in a case shown in FIG. 1, the steel has a composition in which two phases of $\alpha$ and $\gamma$ coexist over a wide temperature range (in other words, the composition whose $(\alpha+\gamma)$ region lies on a line substantially perpendicular to the abscissa) and the steel is subjected to the heat treatment steps shown on the right hand sides of FIG. 1. For example, in a steel having a chemical composition shown by 1 in FIG. 1, a temperature at which the volume ratio of austenite and ferrite manifesting the desired strength and the vibration attenuation performance can be determined from the phase diagram (for example, at a temperature 2' shown in FIG. 1, the volume ratio of ferrite to austenite is expressed by $\overline{PR}/\overline{RQ}$ that shows the strength and the attenuation performance). When the steel is maintained at the determined temperature for an interval (5 minutes to 3 hours) in which the thermodynamical equilibrium is obtained, the carbon dissolves into the austenite phase whereas chromium, tungsten, aluminum and cobalt densely dissolve into the ferrite phase. Then, when the solid solution is cooled at a sufficiently high speed, the austenite is transformed into martensite. The resulting steel is then tempered for the purpose of increasing toughness and to eliminate the internal stress which hinders movement of the magnetic domain wall, which causes a high vibration attenuation performance by the interaction with the lattice vibration. This tempering is performed at the temperature above 400° C. but below the transformation point (shown by 1' in FIG. 1) for 15 minutes to 3 hours. With a tempering temperature below 400° C., the internal stress would not be eliminated and the strength of the tempered martensite varies gradually depending upon the tempering conditions (time and temperature) is that it becomes possible to delicately adjust the strength and attenuation performance. FIG. 8 shows the relation between the tempering temperature and the vibration attenuation performance.

Figure 2:
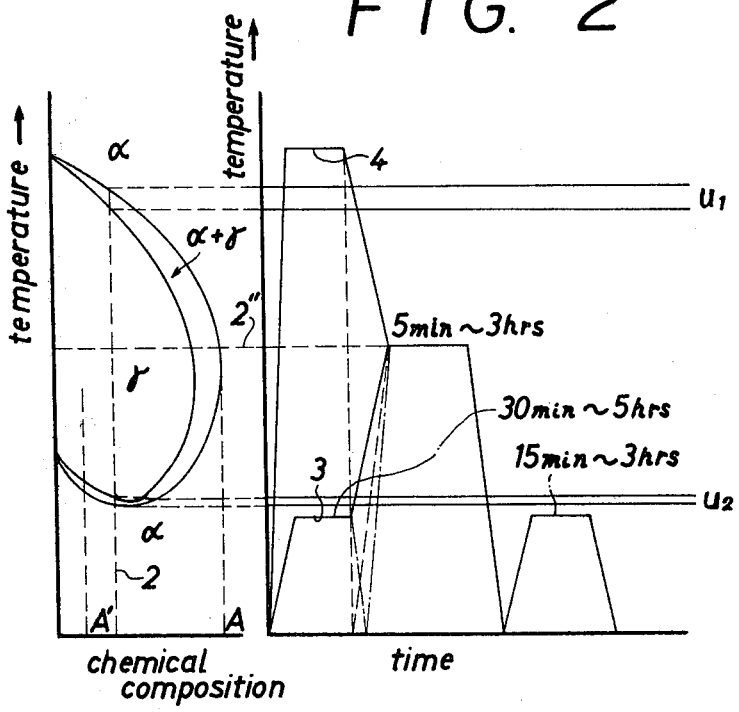
FIG. 2 is a similar diagram showing the result of another example of heat treatment.

FIG. 2 shows a modified embodiment of this invention in which a steel having a composition that exhibits a single phase austenite structure depending upon temperature was subjected to heat treatment steps shown on the right hand side. Thus, steel having a chemical composition corresponding to 2 in FIG. 2 also has temperature ranges $u_1$ and $u_2$ in which two phases of $\alpha$ and $\gamma$ coexist, but these ranges are extremely narrow as shown so that it is almost impossible to practically use these ranges. Accordingly, in this case the solid solution is formed by heating the composition for 30 minutes to 5 hours in a temperature region shown by 3 or 4 outside of the austenite loop temperature region to form steel having a single phase ferrite structure. After cooling the resulting steel to a temperature at or near room temperature, or after directly cooling or heating the steel to a predetermined temperature in an austenite region (to be described later) and then the steel is maintained at that temperature for an interval (5 minutes to 3 hours) in which a volume ratio of austenite and ferrite causes the desired mechanical strength and the vibration attenuation performance. More particularly, in a temperature range shown by 3 or 4 in FIG. 2, the steel is treated to have a single phase ferrite structure and then maintained at a temperature at which the single phase ferrite is transformed into single phase ferrite whereby austenite begins to grow from the boundaries of the austenite ferrite particles and as the time elapses the amount of austenite increases by corroding the ferrite thus proceeding toward a balanced condition at which the structure transforms a single phase austenite. After reaching a predetermined austenite—ferrite volume ratio, the steel is cooled at a sufficiently high speed. Then, austenite transforms into martensite. From the standpoint of thermodynamics, above described holding time of 5 minutes to 3 hours is selected to be shorter than the time during which an equilibrium state can be reached, sufficient amounts of chromium, tungsten, aluminum and cobalt which are effective to exhibit the desired vibration attenuation performance are retained in the ferrite phase and moreover since the diffusion speed of carbon is faster than those of the other elements a sufficient amount of carbon diffuses and dissolves into the austenite phase. The resulting steel is then tempered to increase the toughness and to remove the internal stress that prevents the movement of the movable magnetic domain walls contributing to the improvement in the vibration attenuation performance by the interaction with the lattice vibration just in the same manner as in FIG. 1. Again the tempering temperature ranges from 400° C. and the transformation temperature.

To increase further the hardness of steel incorporated with copper it is advantageous to age the steel at a temperature in a range from 400° C. to 650° C. Although in some cases the aging can also be performed by the tempering treatment, these two treatments can be effected independently. Addition of selenium and tellurium in an amount of less than 0.6% is effective to improve the cutting property of the steel.

Some embodiments of this invention are illustrated in the following. Following Table 1 shows the chemical composition of 8 samples of the steel of this invention. Samples 1, 2 and 3 were incorporated with only chromium, samples 4, 5 and 6 with only tungsten and samples 7 and 8 with chromium and tungsten. Further, samples other than 1 were also incorporated with aluminum and cobalt.

TABLE 1

| Steel Sample | Chemical composition (weight %) | | | | | | | | | |
|---|---|---|---|---|---|---|---|---|---|---|
| | C | Si | Mn | P | S | Cr | W | Al | Co | Fe |
| 1 | 0.080 | 0.20 | 0.53 | 0.005 | 0.008 | 12.08 | — | 1.000 | — | balance |
| 2 | 0.082 | 0.28 | 0.55 | 0.005 | 0.009 | 11.62 | — | 0.800 | 0.300 | " |
| 3 | 0.100 | 0.28 | 0.52 | 0.005 | 0.009 | 11.75 | — | 0.300 | 0.800 | " |
| 4 | 0.030 | 0.005 | 0.50 | 0.011 | 0.006 | — | 3.99 | 0.030 | 2.000 | " |
| 5 | 0.050 | 0.25 | 1.44 | 0.006 | 0.007 | — | 5.81 | 0.500 | 1.000 | " |
| 6 | 0.100 | 0.35 | 1.45 | 0.011 | 0.007 | — | 5.80 | 0.030 | 1.000 | " |
| 7 | 0.101 | 0.35 | 0.70 | 0.005 | 0.009 | 11.80 | 2.10 | 0.900 | 0.300 | " |
| 8 | 0.061 | 0.40 | 0.60 | 0.004 | 0.008 | 10.02 | 2.10 | 0.800 | 1.50 | " |

The heat treatment conditions, the mechanical properties, volume percentage regarding two phases of ferrite and tempered martensite, and the vibration attenuation performance of these samples are shown in the following Table 2.

TABLE 2

| Steel Sample | Heat treatment | | Yielding point (Kg/mm²) | Tensile strength (Kg/mm²) | Elongation (%) | Martensite volume fraction (%) | Vibration attenuation performance (ratio to SPCC) |
|---|---|---|---|---|---|---|---|
| 1 | 950° C. × 30 min. | AC | 28.2 | 48.1 | 26 | 14.8 | 165.0 |
| | 750° C. × 1 hr. | AC | | | | | |
| 2 | 975° C. × 30 min. | AC | 28.2 | 46.3 | 28 | 10.3 | 216.5 |
| | 750° C. × 1 hr. | AC | | | | | |
| 3 | 1350° C. × 3 hrs. | AC | 34.2 | 50.1 | 23 | 32.9 | 102.5 |
| | 1000° C. × 15 min. | AC | | | | | |
| | 750° C. × 1 hr. | AC | | | | | |
| 4 | 1200° C. × 30 min. | AC | 37.0 | 45.2 | 31 | 29.0 | 74.0 |
| | 700° C. × 1 hr. | AC | | | | | |
| 5 | 1350° C. × 30 min. | AC | 36.6 | 53.1 | 23 | 43.2 | 130.0 |
| | 800° C. × 1 hr. | AC | | | | | |
| 6 | 1350° C. × 30 min. | AC | 39.5 | 55.5 | 20 | 40.5 | 90.7 |
| | 800° C. × 1 hr. | AC | | | | | |
| 7 | 1350° C. × 3 hrs. | | 33.4 | 49.2 | 24 | 34.0 | 115.0 |
| | 1000° C. × 15 min. | AC | | | | | |
| | 750° C. × 1 hr. | AC | | | | | |
| 8 | 970° C. × 30 min. | AC | 29.0 | 47.0 | 25 | 28.4 | 160.0 |

TABLE 2-continued

| Steel Sample | Heat treatment | Yielding point (Kg/mm²) | Tensile strength (Kg/mm²) | Elongation (%) | Martensite volume fraction (%) | Vibration attenuation performance (ratio to SPCC) |
|---|---|---|---|---|---|---|
| | 750° C. × 1 hr. AC | | | | | |

Remark:
AC means "air cool"
SPCC means a type of steel specified by JIS (Japanese Industrial Standard)

Respective samples were prepared by melting the ingredients and then casting. Irrespective of the fact that whether the ingredients were melted in vacuum or in the atmosphere, satisfactory results were obtained. The cast ingot was hot rolled to obtain a steel sheet having a thickness of 3 mm followed by cold rolling thus obtaining steel plate having a thickness of from 2 mm to 0.5 mm. In addition, steel rods having a diameter of 50 mm were also prepared. The heat treatments shown in Table 2 were applied to test pieces having a width of 20 mm and a length of 100~300 mm which were prepared by cutting the steel sheets.

The vibration attenuation performance was obtained by applying to respective test pieces a bending vibration having an amplitude such that the maximum bending stress is in a range of 1/10 to 1/5 of the yielding stresses of respective test pieces and at a resonance frequency of a bending vibration of a primary mode corresponding to the thickness and length of the test piece, then instantly removing the applied vibration and finally recording the attenuation curves of free vibrations.

When the test pieces having dimensions described above were used it was possible to vary the resonance frequency in a range of from about 20 to 1000 Hz and the vibration energy absorption rate of the steel per one period was determined over five periods according to the following equation and by utilizing the free vibration attenuation curve.

$$\text{Vibration energy absorption rate} = \frac{1}{5}\sum_{n=1}^{5}\frac{An^2 - A^2n + 1}{An^2}$$

where An represents the amplitude of the free attenuation vibration at the nth period.

For comparison, a normalized test piece of a steel sheet (JIS SPCC soft steel plate) having a thickness of 0.5 mm, a width of 20 mm and a length of 220 mm was subjected to a bending vibration of the primary mode at a resonance frequency and having a amplitude of a maximum bending stress corrsponding to 1/10 of the yielding stress of the test piece, and the vibration energy absorption rate was determined from the free attenuation vibration curve in the same manner as above described. This rate was taken as 10 which was compared with the vibration energy absorption rate of the test pieces of this invention in the measuring range described above to determine the vibration attenuation performances which are shown in Table 2.

Although the SPCC steel sheet normalized as above described have considerably high vibration attenuation performance, the result shown in Table 2 shows that the steel plates of this invention have sufficiently higher vibration attenuation performance than these SPCC steel plates.

Figure 3:
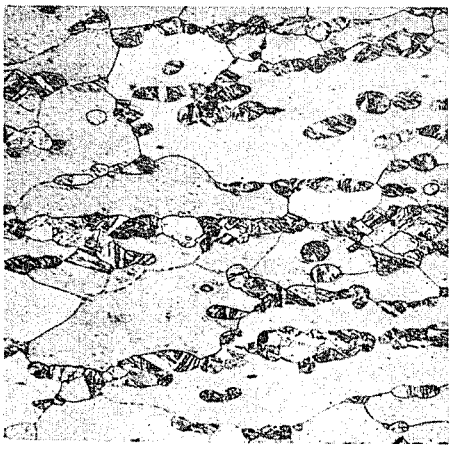
FIGS. 3 and 4 are micrographs showing microstructures of ferrite and tempered martensite respectively of steels prepared according to this invention.
Figure 4:
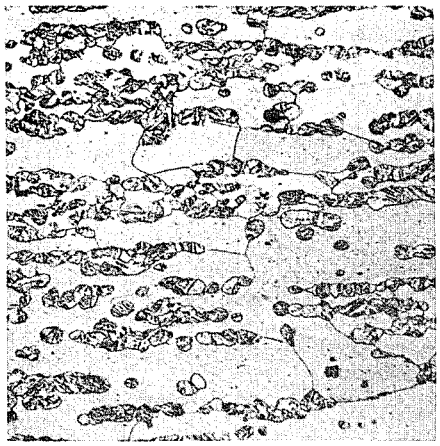

The structure of the samples 2 and 4 of this invention are shown by the micrographs shown in FIGS. 3 and 4 respectively, which clearly show two phase structure of ferrite and tempered martensite that characterize the invention.

Table 3 below shows the chemical composition of comparative samples 11~13 in which comparative sample 11 does not contain aluminum and cobalt, sample 12 contains chromium up to 4% and sample 13 contains chromium and aluminum both in the range of this invention, but was not subjected to a tempering treatment as in Table 4 so that the internal stress is not removed.

TABLE 3

| Sample | C | Si | Mn | P | S | Cr | W | Al | Co | Fe |
|---|---|---|---|---|---|---|---|---|---|---|
| 11 | 0.050 | 0.22 | 0.46 | 0.011 | 0.009 | 12.38 | — | 0.015 | — | balance |
| 12 | 0.082 | 0.28 | 0.55 | 0.005 | 0.009 | 4.00 | — | 0.750 | 1.300 | " |
| 13 | 0.082 | 0.20 | 0.53 | 0.005 | 0.008 | 12.05 | — | 1.100 | — | " |

The heat treating condition, mechanical properties, volume percentage with reference to two phases described above and the vibration attenuation performance of these comparative samples are shown in the following Table 4.

TABLE 4

| Sample | Heat treatment | Yielding point (Kg/mm²) | Tensile strength (Kg/mm²) | Elongation (%) | Martensite volume fraction (%) | Vibration attenuation performance (ratio to SPCC) |
|---|---|---|---|---|---|---|
| 11 | 1000° C. × 30 min. AC<br>750° C. × 1 hr. AC | 49.2 | 59.8 | 15 | 31.0 | 33.0 |
| 12 | 975° C. × 30 min. AC<br>750° C. × 1 hr. AC | 26.5 | 44.0 | 32 | 60.5 | 20.0 |
| 13 | 950° C. × 30 min. AC | 33.2 | 53.4 | 22 | 15.3 | 45.4 |

Comparison of Tables 2 and 4 shows that the vibration attenuation performances of control samples 11, 12 and 13 are inferior than the samples of this invention.

Figure 5:
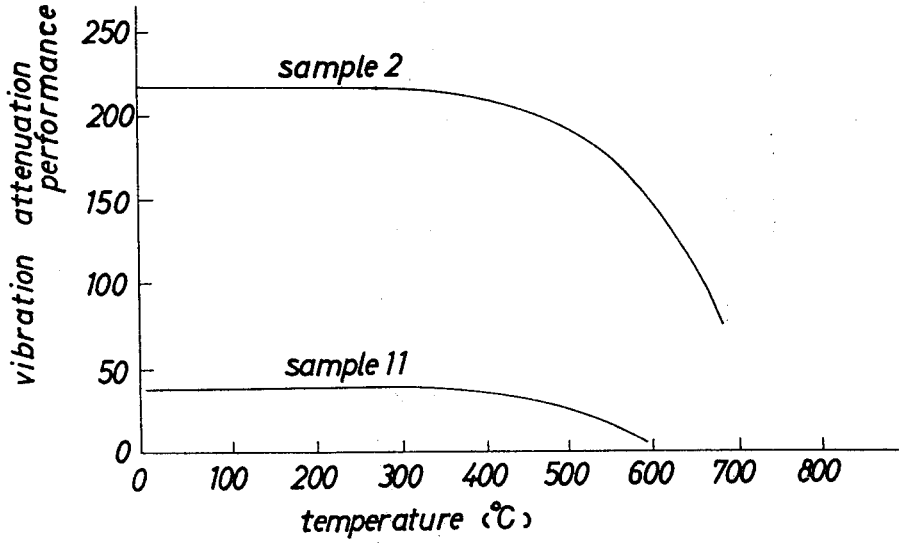
FIG. 5 is a graph showing the relationship between the vibration attenuation performance and temperature of the steel of this invention and a comparative steel.
Figure 6:
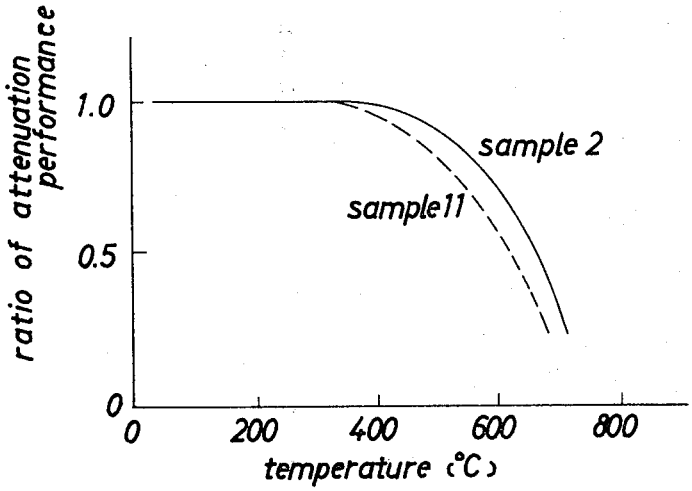
FIG. 6 is a graph showing the relationship between the ratio of the vibration attenuation performance at various temperatures to the vibration attenuation performance at room temperature, and the temperature of the steel of this invention and a comparative steel.

FIG. 5 shows the effect of temperature upon the vibration attenuation performance of the sample 2 of this invention and the control sample 11 whereas FIG. 6 shows the relationship between the ratio of vibration attenuation performance at respective temperatures and the vibration attenuation performance at room temperature, and temperature.

As shown, sample 2 is more excellent than comparative sample 11 at respective temperatures. Sample 2 containing both aluminum and cobalt has substantially the same vibration attenuation performance even at 450° C. as that at room temperature whereas in the control sample 11, the vibration attenuation performance begins to decrease at lower temperatures.

Figure 7:
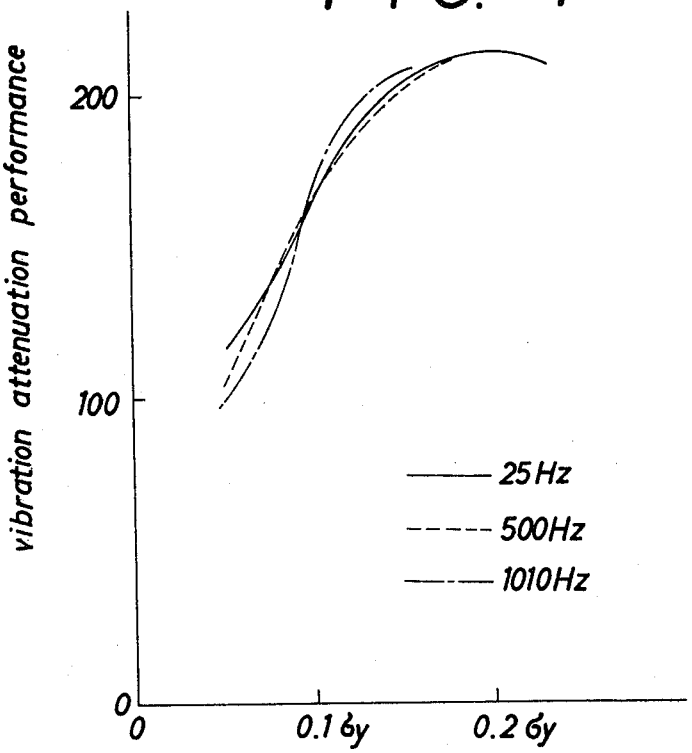
FIG. 7 is a graph showing the relationship between the vibration attenuation performance of the steel of this invention and frequency.

FIG. 7 shows the frequency of the vibration attenuation performance of sample 2 which shows that the vibration attenuation performance of the steel of this invention does not depend on frequency. In other words, the vibration attenuation performance of the steel of this invention is substantially the same for high and low frequencies.

1.00% of copper was added to sample 1 and shaped into a plate having a thickness of 12 mm. This sample was then heated at a temperature of 950° C. for one hour, air cooled, heated at a temperature of 750° C. for two hours, air cooled, heated at a temperature of 600° C. for one hour and then air cooled. The resulting sample had a yielding stress of 38.3 $Kg/mm^2$, a maximum stress of 59.2 $Kg/mm^2$ and a high vibration attenuation performance ratio of 165 to SPCC which is comparable with that of sample 1.

Since the steel of this invention can exhibit a high vibration attenuation performance by a specific composition and by the adjustment of the amount of the tempered martensite, so that the performance would not be impared greatly even when the steel is subjected to such heat treatment that changes the volume ratio of a small portion of the steel. This example will now be described. A sample having the same composition as sample 1 was prepared except that 1.00% of copper was incorporated. This sample was formed into a rod having a diameter of 50 mm. The rod was heated at a temperature of 950° C. for one hour, maintained in a carburizing atmosphere for one hour at that temperature and then air cooled to obtain steel having a predetermined vibration attenuation performance. The steel was then quickly heated to 850° C. by high frequency heating, maintained at this temperature for 15 minutes, then quenched in an oil tank, maintained in the oil for one hour to homogenize the temperature, maintained at 130° C. for two hours and finally air cooled. The surface layer was carburized and hardened to a thickness of about 0.3 to 0.5 mm. The internal friction $Q^{-1}$ was measured by ultra sonic wave absorption method which was found to be about 90% of the value of $Q^{-1}$ of sample 1 described above, thus showing that the vibration attenuation performance is about 150. The Vickers hardness of the surface was 820. Since the rod was rapidly heated to 850° C. and maintained at this temperature for 15 minutes the temperature of the central portion of the rod was suitable for precipitation hardening.

It should be understood that the invention is not limited to the specific examples described above and that various modifications may be made without departing from the true spirit and scope of the invention.

Thus the invention provides steel having excellent vibration attenuation performance in addition to desired mechanical strength, toughness, corrosion proof property, weldability and other characteristics. The steel of this invention is useful to decrease vibrations and noise generated by various machines and apparatus thus avoiding the fatique thereof and improving the life. In addition, the steel of this invention can be manufactured without increasing the manufacturing cost and the volume. Furthermore, the steel of this invention can be used in a wide range of the operating temperature.

What is claimed is:

1. A process of using shaped alloyed steel for vibration attenuation comprising contacting said shaped steel with vibratory energy whereby said shaped steel absorbs vibration energy and attenuates the vibrations, said steel having a structure of ferrite and tempered martensite and exhibiting excellent vibration attenuation performance, said steel consisting essentially of 0.02–0.16% by weight of carbon; less than 0.6% by weight of silicon; 0.5–1.5% by weight of manganese; either one or both of 5–15% by weight of chromium; and 2–9% by weight of tungsten; either one or both of 0.03–2% by weight of aluminum and 0.1–5% of cobalt; and the balance of iron.

2. The process of claim 1 wherein said alloyed steel also contains copper in an amount less than 1.5% by weight.

3. The process of claim 1 wherein said alloyed steel contains less than 60% by weight of said tempered martensite.

4. The process of claim 1 or 2 or 3 wherein said alloyed steel was treated to form the structure of ferrite and tempered martensite by heating and maintaining the alloyed steel at a temperature in which austenite and ferrite coexist, then cooling to transform the austenite to martensite; then tempering at a temperature of between 400° C. and 650° C. thereby forming said structure of ferrite and tempered martensite.

5. The process of claim 4 further comprising the surface layer of said steel , rapidly heating to a hardening temperature and then quenching.

6. A process for improving the vibration attenuation characteristics of an alloyed steel consisting essentially of 0.02–0.6% by weight of carbon, less than 0.6% by weight of silicon, 0.5–1.5% by weight of manganese, either one or both of 5–15% by weight of chromium and 2–9% by weight of tungsten, either one or both of 0.03–2% by weight of aluminum and 0.1–5% by weight of cobalt, and the balance of iron; comprising heating and maintaining said steel at a temperature in which austenite and ferrite coexist; cooling said steel to transform the austenite to martensite; and tempering said steel at a temperature of from 400° C. to a temperature lower than the transformation point thus forming a structure of ferrite and tempered martensite and improving the vibration attenuation characteristics of said steel and then contacting said steel with an environment comprising vibratory motion.

7. The process of claim 6 wherein said alloyed steel also contains copper in an amount less than 1.5% by weight.

8. The process of claim 7 wherein said cooled steel is tempered at a temperature of about 400° C. to 650° C.

9. The process of claim 6, 7 or 8 which further comprises the steps of carburizing the surface layer to a hardening temperature and then quenching the steel.

10. Steel machine components having a ferrite and tempered martensite structure and characterized by their effect of attenuating vibrations, said steel consisting essentially of from 0.02 to 0.16% by weight carbon, less than 0.6% silicon, from 0.5 to 1.5% manganese, at least one metal selected from the group consisting of chromium and tungsten in an amount of from 5 to 15% chromium and from 2 to 9% tungsten, at least one metal selected from the froup consisting of aluminum and cobalt in an amount of from 0.03 to 2% aluminum and from 0.1 to 5% cobalt, and the balance iron;

said steel having been processed by heating and maintaining said steel in a temperature range wherein austenite and ferrite coexist, cooling said steel so as to transform the austenite to martensite; and tempering said steel at a temperature of from 400° C. to a temperature lower than the transformation point whereby said steel characterized by the ability to attenuate vibrations and having said structure of ferrite and tempered martensite is formed.

11. The components of claim 10 wherein said steel further contains copper in an amount less than 1.5%.

12. The components of claim 10 or 11 wherein said tempering is carried out at a temperature of between 400° C. and 650° C.

13. The components of claim 12 having a hardened surface wherein the surface layer of said steel components has been carburized, followed by rapid heating said surface layer to a hardening temperature and quenching to produce said hardened surface.

* * * * *

UNITED STATES PATENT AND TRADEMARK OFFICE

CERTIFICATE OF CORRECTION

PATENT NO. : 4,410,374

DATED : October 18, 1983

INVENTOR(S) : Namio URABE

It is certified that error appears in the above-identified patent and that said Letters Patent is hereby corrected as shown below:

Column 10, line 31, Claim 5: after "comprising" insert --carburizing--.

Column 10, line 36, Claim 6: "0.02-0.6%" should be --0.02-0.16%--.

Column 10, line 57, Claim 9: after "layer" insert --of said steel, rapidly heating said surface layer--.

Column 10, last line, Claim 10: "froup" should be --group--.

Signed and Sealed this

Fifth Day of June 1984

[SEAL]

*Attest:*

GERALD J. MOSSINGHOFF

*Attesting Officer*

*Commissioner of Patents and Trademarks*